US006354712B1

(12) United States Patent
Anteby

(10) Patent No.: US 6,354,712 B1
(45) Date of Patent: Mar. 12, 2002

(54) INERTIAL SWITCH FOR LIGHTED FOOTWEAR

(75) Inventor: Edward J. Anteby, Long Branch, NJ (US)

(73) Assignee: E. S. Originals, Inc., New York, NY (US)

( * ) Notice: Subject to any disclaimer, the term of this patent is extended or adjusted under 35 U.S.C. 154(b) by 0 days.

(21) Appl. No.: 09/479,297

(22) Filed: Jan. 6, 2000

(51) Int. Cl.[7] ..... F21V 21/08

(52) U.S. Cl. ..... 362/103; 362/276; 362/200; 362/204; 362/203; 362/802

(58) Field of Search ..... 362/103, 276, 362/200, 802, 204, 203; 200/61.45 R, 61.52, 52, 277; 36/137

(56) References Cited

U.S. PATENT DOCUMENTS 2,572,760 A * 10/1951 Rikelman ..... 362/103
5,599,088 A * 2/1997 Chien ..... 362/103

* cited by examiner

*Primary Examiner*—Sandra O'Shea
*Assistant Examiner*—Bertrand Zeade
(74) *Attorney, Agent, or Firm*—Kirschstein, et al.

(57) ABSTRACT

An inertially responsive switch for use in footwear for electrically connecting a battery with a light includes an electrically conductive ball mounted in a housing for rolling movement about an upright axis along which a pair of electrical terminals are spaced apart. When the ball contacts the terminals, an electrical current from the battery passes along the terminals and the ball in order to illuminate the light.

7 Claims, 1 Drawing Sheet

INERTIAL SWITCH FOR LIGHTED FOOTWEAR

BACKGROUND OF THE INVENTION

1. Field of the Invention

The present invention generally relates to lighted footwear and, more particularly, to a motion responsive switch for use in creating an attractive lighting pattern.

2. Description of the Related Art

Lighted footwear is popular with children and adults, not only for its safety aspect in which illuminated lights on the footwear render the wearer more visible especially at night, but also for its aesthetic appeal. Such lighted footwear typically includes at least one light source and preferably a plurality of light sources such as light emitting diodes (LEDs), a source of power preferably a battery, and a switch to connect the battery to the LEDs and cause the latter to light.

The switch can be a simple manual switch as disclosed, for example, in U.S. Pat. No. 4,158,922. The switch could be a mercury switch in which a ball of mercury runs back and forth along a tube between a pair of electrical contacts during motion of the footwear, as disclosed in U.S. Pat. No. 4,848,009. The switch can be a pressure responsive switch which opens and closes in response to application of the wearer's weight on the switch as disclosed, for example, in U.S. Pat. No. 5,285,586. The switch can be a spring switch in which a cantilevered spring in the form of a coil oscillates back and forth to make and break contact with an electrical contact as, for example, shown in U.S. Pat. No. 5,408,764. The switch may include a metal ball that moves when the footwear moves. Thus, as shown in U.S. Pat. No. 2,572,760, a ball rolls back and forth along a tube pivotably mounted on a shoe to tilt the tube and cause a light to flash. U.S. Pat. No. 5,438,493 discloses a ball that moves along a sliding way to control operation of a switch. U.S. Pat. No. 5,483,759 discloses a ball that rolls across multiple contacts during walking or running.

To increase battery life and to provide a more attractive eye-catching and safer display, it is desirable to cause the light to flash on and off, rather than being maintained continuously illuminated while the switch is closed. This can be accomplished mechanically by the back and forth movement of the above-described mercury or metal balls, or by the oscillation of the aforementioned coil spring, or by the intermittent application of weight in a pressure responsive switch.

Another way to cause flashing is electronically by use of an oscillator or flasher, preferably at low speeds on the order of a few Hertz, as for example described in U.S. Pat. No. 4,158,922. The switch is then used not to make intermittent contact, but instead, a switch closure is employed to trigger an electronic component such as an integrated circuit to initiate a flashing light sequence.

As advantageous as these known switches have been, experience has shown that there are still drawbacks in their use. Mercury switches are no longer used for environmental reasons. Metal balls do not always make a reliable electrical contact. Pressure responsive switches, as well as the aforementioned mercury and metal ball rolling switches, can, under certain circumstances, remain continuously closed, thus allowing the lights to stay on until eventually the battery is exhausted. For example, during transport, shoes with such switches can be packed at an attitude corresponding to a step during walking or running, or can be tightly packed together with sufficient pressure to maintain the lights on and exhaust the battery.

SUMMARY OF THE INVENTION

Objects of the Invention

Accordingly, it is a general object of this invention to improve the state of the art of motion responsive switches used in lighted footwear.

More particularly, it is an object of the present invention to provide an inertial switch that makes a reliable electrical connection during use.

Features of the Invention

In keeping with the above objects and others which will become apparent hereafter, one feature of the present invention resides, briefly stated, in an inertial switch mounted together with a battery and at least one light on footwear for joint movement therewith. The switch includes a housing having walls bounding an interior. The walls include upper and lower walls spaced apart along an upright longitudinal axis, as well as side walls spaced apart along a transverse axis generally perpendicular to the longitudinal axis. In one embodiment, the housing is a circular cylinder, and the upper and lower wells lie in parallel planes perpendicular to the longitudinal axis. The side walls extend circumferentially around the longitudinal axis. In another embodiment, the housing is a hollow sphere.

The switch includes a pair of upper and lower electrical terminals respectively mounted on the upper and lower walls. The terminals are spaced apart by a first distance along the longitudinal axis. The terminals are spaced from the side walls by a second distance along the transverse axis.

An electrically conductive rolling ball is mounted in the interior of the housing for rolling with multiple freedoms of movement. The ball has a diameter greater than the first distance and less than the second distance. The ball is free to roll between a non-contacting position in which the ball is spaced away from the terminals, and a contacting position in which the ball contacts the terminals and electrically connects the battery and the light to illuminate the light.

In the preferred embodiment, the longitudinal axis extends centrally of the housing, and the housing is symmetrical relative to the longitudinal axis. The terminals are preferably configured as circular plates whose centers lie on the longitudinal axis.

In use, the ball rolls in many directions, including around the longitudinal axis as the footwear is moved. When the ball moves radially toward the longitudinal axis, the ball engages both terminals simultaneously due to its greater diameter and effectively allows an electrical current to pass through the ball between the terminals. When the ball moves radially outwardly away from the terminals toward the side walls, there is sufficient room in the housing for the ball to be spaced out of contact with the terminals. The switch therefore closes when the ball engages the terminals, and opens when the ball is disengaged from the terminals.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
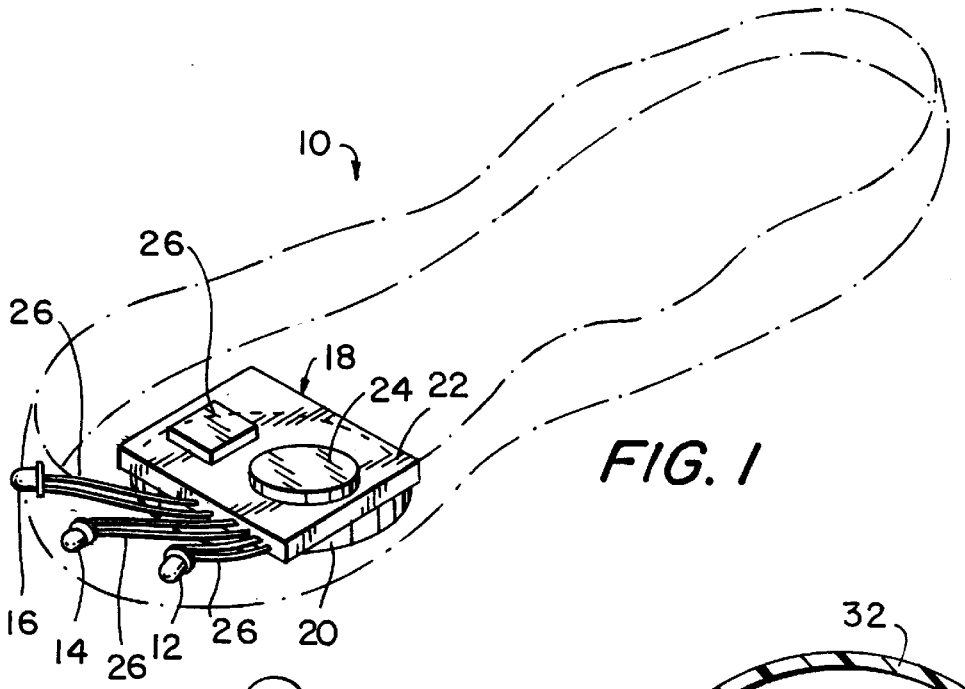
FIG. 1 is a perspective view of an inertial switch mounted on lighted footwear shown in phantom lines according to this invention.

Referring now to FIG. 1, reference numeral 10 generally identifies a sole of a shoe, the sole being shown in phantom lines. The shoe can be an athletic, casual, or formal shoe, or it can be a boot or a sandal, or, in brief, any kind of footwear for men, women or children.

A lighting system is incorporated in the sole, and includes at least one light source and preferably a plurality of light sources, e.g., LEDs 12, 14, 16. Rather than light emitting diodes, incandescent, electroluminescent, infrared or ultraviolet light sources may be used. The sources are shown arranged around the periphery of the heel of the sole, but they can be arranged anywhere on the shoe, including the upper. More or fewer than three sources can be used.

The sources receive electrical current from a module 18 preferably embedded in the sole. The module contains a battery 20 typically a 3 volt lithium battery having the shape of a circular disk. The battery 20 is mounted on one side of a printed circuit board 22.

The module also contains an inertial switch 24 on the opposite side of the board 22, for controlling the lighting of the sources. Electrically conductive wires 26 extend from the sources to the module to conduct the electrical current from the battery as permitted by the switch 24.

Optionally, the module contains an integrated circuit component 26 connected in series to the switch, the battery and the sources. This component 26 includes a low frequency oscillator for causing the sources to flash. The flashing may be performed in random or predetermined sequences as triggered by a change of state of the switch. The electrical connections among the battery, sources, switch and the integrated circuit component have been omitted from FIG. 1 for the sake of clarity. An integrated circuit component especially suitable is described in a concurrently filed U.S. patent application entitled "Lighted Footwear Module With Random Time Delay", the entire contents of which are hereby incorporated by reference herein.

Figure 2:
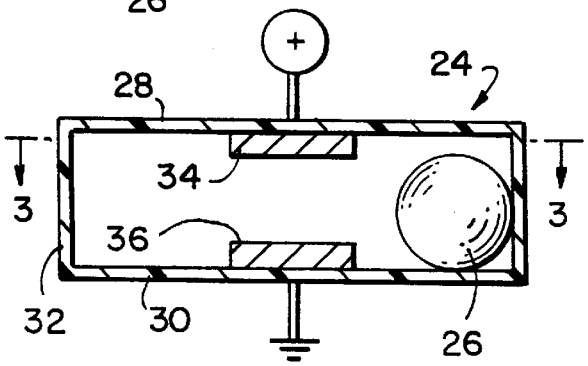
FIG. 2 is a sectional view on an enlarged scale of one embodiment of an inertial switch.
Figure 3:
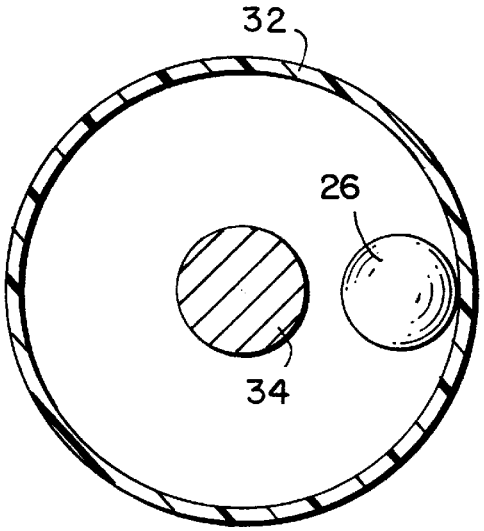
FIG. 3 is a sectional view taken on line 3—3 of FIG. 2.

In accordance with this invention, the switch 24 includes an electrically conductive, metal ball 26 mounted with multiple freedoms of movement in a housing. In the embodiment of FIGS. 2 and 3, the housing is a circular cylinder having an upper planar wall 28 and a lower planar wall 30 lying in parallel planes and spaced apart along an upright, vertical, longitudinal axis. A side wall 32 extends circumferentially around the longitudinal axis. Opposite wall portions of the side wall are spaced apart along a transverse axis generally perpendicular to the longitudinal axis. The housing is symmetrical relative to the longitudinal axis. The longitudinal axis extends centrally through the housing.

An upper terminal 34 and a lower terminal 36 are mounted on the upper and lower walls 28, 30, respectively. The upper terminal is an electrically conductive, circular plate that is electrically connected in series with a positive terminal of the battery. The lower terminal is also an electrically conductive, circular plate that is electrically connected in series with a negative terminal of the battery, and is grounded. The housing itself is constituted of an electrically insulating material, such as synthetic plastic material.

As shown in FIGS. 2 and 3, the terminals 34, 36 are spaced apart along the longitudinal axis by a first distance which is less than the diameter of the ball 26. The terminals 34, 36 are spaced away from the side wall 32 along the transverse direction by a second distance which is greater than the ball diameter.

In use, the ball 26 is free to roll around on the lower wall 30 as the footwear is moved. When the ball moves radially inwardly toward the longitudinal axis, the ball contacts both terminals simultaneously and creates a conductive path through itself between the terminals. The switch is now closed, and an electrical current from the battery is conducted to the sources through the switch to cause the sources to light. When the ball moves radially outwardly toward the side wall 32, the ball no longer contacts both terminals, and the path is interrupted. The switch is now open, and no sources are illuminated. When the integrated circuit component is used, the change of state of the switch, i.e., from open to closed, or from closed to open, is used to trigger the component to initiate a flashing sequence in which the sources are lit in various random or predetermined patterns.

Figure 5:
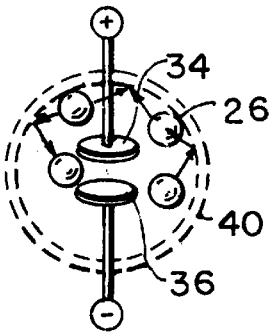
FIG. 5 is a perspective view of the embodiment of FIG. 4 depicting ball movement during use.
Figure 4:
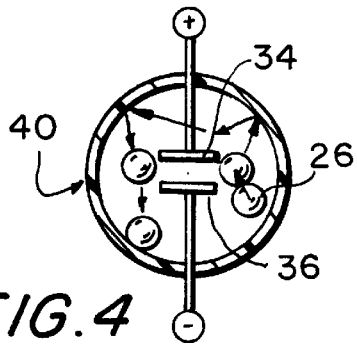
FIG. 4 is a sectional view of another embodiment of an inertial switch.

In an alternate embodiment, the housing, as shown in FIGS. 4 and 5, is a hollow sphere 40 in which the upper and lower terminals 34, 36 are spaced apart, as described earlier, along an upright longitudinal axis by a first distance less than the diameter of the ball 26. The terminals are spaced from the side wall of the sphere by a second distance greater than the ball diameter. The operation is as before, except that the ball 26 does not roll on a planar lower wall 30, but instead rolls along a concave lower wall.

In both illustrated embodiments, it is not likely that the ball will stay in contact with both terminals for extended periods of time and, indeed, such contact is brief at best since the ball will repeatedly bounce off the centrally disposed terminals.

Multiple balls can also be used, as shown in FIGS. 4 and 5, to increase the frequency of the contact between any one ball and both terminals.

It will be understood that each of the elements described above, or two or more together, also may find a useful application in other types of constructions differing from the types described above.

While the invention has been illustrated and described as embodied in an inertial switch for lighted footwear, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims:

I claim:

1. In footwear having a light and a battery, an inertially responsive switch mounted for joint movement with the light and the battery on the footwear, the switch comprising:

a) a housing having walls bounding an interior, the walls including upper and lower walls spaced apart along an upright longitudinal axis, and side walls spaced apart along a transverse axis generally perpendicular to the longitudinal axis;

b) a pair of upper and lower electrical terminals respectively mounted on the upper and lower walls and spaced apart by a first distance along the longitudinal axis, the terminals being spaced by a second distance along the transverse axis from the side walls; and c) an electrically conductive rolling ball mounted in the interior of the housing for rolling with multiple freedoms of movement, the ball having a diameter greater than said first distance and less than said second distance, the ball being rollable between a non-contacting position in which the ball is spaced away from both of the terminals, and a contacting position in which the ball simultaneously contacts both of the terminals and electrically connects the battery and the light through the ball to illuminate the light.

2. The switch according to claim 1, wherein the housing is generally cylindrical, and wherein the upper and lower walls are generally planar and are generally parallel to each other, and wherein the side walls extend circumferentially around the longitudinal axis.

3. The switch according to claim 1, wherein the housing is generally spherical.

4. The switch according to claim 1, wherein the longitudinal axis extends centrally of the housing, and wherein the housing is symmetrical relative to the longitudinal axis.

5. The switch according to claim 1, wherein the terminals include generally circular plates that are symmetrical relative to the longitudinal axis, and wherein the ball rolls around the plates.

6. The switch according to claim 1, wherein the housing is constituted of an electrically insulating material.

7. The switch according to claim 1, and further comprising another rolling ball mounted in the housing.

* * * * *